US009957741B2

(12) United States Patent
Taylor et al.

(10) Patent No.: US 9,957,741 B2
(45) Date of Patent: May 1, 2018

(54) DOOR SECURITY DEVICE

(71) Applicants: Joseph Curtis Taylor, Birch Run, MI (US); Jack Taylor, Clio, MI (US)

(72) Inventors: Joseph Curtis Taylor, Birch Run, MI (US); Jack Taylor, Clio, MI (US)

( * ) Notice: Subject to any disclaimer, the term of this patent is extended or adjusted under 35 U.S.C. 154(b) by 0 days. days.

(21) Appl. No.: 15/394,099

(22) Filed: Dec. 29, 2016

(65) Prior Publication Data

US 2017/0145721 A1 May 25, 2017

Related U.S. Application Data

(63) Continuation of application No. 14/800,189, filed on Jul. 15, 2015, now Pat. No. 9,534,430, which is a continuation of application No. 14/551,829, filed on Nov. 24, 2014, now abandoned, which is a continuation of application No. 14/172,485, filed on Feb. 4, 2014, now Pat. No. 8,894,110.

(60) Provisional application No. 61/760,825, filed on Feb. 5, 2013.

(51) Int. Cl.

| | |
|---|---|
| ***E05C 17/44*** | (2006.01) |
| ***E05C 19/00*** | (2006.01) |
| *E05C 19/18* | (2006.01) |

(52) U.S. Cl.

CPC ..... *E05C 19/003* (2013.01); *Y10S 292/15* (2013.01)

(58) Field of Classification Search

CPC ..... Y10S 292/15
USPC ..... 292/288, 289
See application file for complete search history.

(56) References Cited

U.S. PATENT DOCUMENTS

| | | | | |
|---|---|---|---|---|
| 1,544,268 | A | 6/1925 | Murray | |
| 1,571,543 | A * | 2/1926 | Fratzke | E05C 19/18 292/258 |
| 2,205,614 | A | 6/1940 | Bashe | |
| 3,833,963 | A | 9/1974 | Waters | |
| 4,139,249 | A | 2/1979 | Hillman | |
| 4,163,574 | A | 8/1979 | Chezem | |

(Continued)

FOREIGN PATENT DOCUMENTS

DE 1036482 B 8/1958

OTHER PUBLICATIONS

Final Office Action in U.S. Appl. No. 14/551,829, dated Jan. 16, 2015.

(Continued)

*Primary Examiner* — Carlos Lugo
(74) *Attorney, Agent, or Firm* — Harness, Dickey & Pierce, P.L.C.

(57) ABSTRACT

A device for restricting movement of a door includes a door member, a floor member, and a connecting member. The door member is fixedly mounted to a door and includes a first opening having a first predetermined shape. The floor member is fixedly mounted to a floor and includes a second opening having a second predetermined shape. The connecting member includes a first leg and a second leg. The first leg extends in a first direction and has a first end removeably engaging the first opening. The second leg extends in a second direction that is perpendicular to the first direction and has a second end removeably engaging the second opening simultaneously when the first end removeably engages the first opening thereby preventing rotation of the door.

18 Claims, 12 Drawing Sheets

(56) References Cited

U.S. PATENT DOCUMENTS

| | | | | |
|---|---|---|---|---|
| 4,270,668 | A * | 6/1981 | Berfield | A47L 9/00 220/324 |
| 4,579,377 | A | 4/1986 | Dallaire et al. | |
| 4,714,284 | A | 12/1987 | Varlet | |
| 4,955,648 | A * | 9/1990 | Miller | E05C 19/18 292/258 |
| 5,040,835 | A | 8/1991 | Barker | |
| 5,199,759 | A | 4/1993 | Anderson | |
| 5,226,201 | A * | 7/1993 | Lefebvre | E05C 17/52 16/82 |
| 5,292,013 | A | 3/1994 | Earl | |
| 5,383,254 | A | 1/1995 | Wigley, Sr. | |
| 5,445,451 | A | 8/1995 | Harmony | |
| 5,454,143 | A | 10/1995 | Wigley, Sr. | |
| 5,454,610 | A | 10/1995 | Taylor et al. | |
| 5,531,490 | A | 7/1996 | Parker | |
| 5,590,918 | A | 1/1997 | Kambalov | |
| 5,590,928 | A | 1/1997 | Voiculescu | |
| 5,601,320 | A | 2/1997 | Miller | |
| 5,645,304 | A | 7/1997 | Richardson et al. | |
| 5,771,533 | A | 6/1998 | Kuang-Pin | |
| 5,865,484 | A * | 2/1999 | Johns | E05C 19/182 292/288 |
| 5,904,325 | A | 5/1999 | Hung | |
| 6,340,185 | B1 | 1/2002 | Truong | |
| 6,382,689 | B1 | 5/2002 | Brown | |
| 6,397,645 | B1 | 6/2002 | Grant, Jr. | |
| 6,471,264 | B1 | 10/2002 | Ryan | |
| 6,484,445 | B2 | 11/2002 | Chang | |
| 6,550,828 | B2 | 4/2003 | Warden | |
| 6,666,486 | B1 | 12/2003 | Fleming | |
| 7,651,140 | B2 | 1/2010 | Leggio | |
| D612,717 | S | 3/2010 | Frankel | |
| 8,510,994 | B2 * | 8/2013 | Scott | E05B 9/08 292/289 |
| 8,894,110 | B2 * | 11/2014 | Taylor | E05C 19/184 292/288 |
| 9,482,034 | B2 * | 11/2016 | Atkinson, Jr. | E05B 63/18 |
| 9,534,430 | B2 * | 1/2017 | Taylor | E05C 19/184 |
| 2013/0193695 | A1 | 8/2013 | Taylor et al. | |

OTHER PUBLICATIONS

Non-Final Office Action in U.S. Appl. No. 14/172,485, dated Mar. 25, 2014.

* cited by examiner

DOOR SECURITY DEVICE

CROSS-REFERENCE TO RELATED APPLICATIONS

This application is a continuation of U.S. patent application Ser. No. 14/800,189 filed on Jul. 15, 2015 (now U.S. Pat. No. 9,534,430, to issue on Jan. 3, 2017), which is a continuation of U.S. patent application Ser. No. 14/551,829 filed on Nov. 24, 2014, which is a continuation of U.S. patent application Ser. No. 14/172,485 filed on Feb. 4, 2014 (now U.S. Pat. No. 8,894,110, issued on Nov. 25, 2014), which claims the benefit of U.S. Provisional Application No. 61/760,825 filed on Feb. 5, 2013. The entire disclosures of the above applications are incorporated herein by reference.

FIELD

The present disclosure relates to a security device, and more particularly, to a security device for a door.

BACKGROUND

This section provides background information related to the present disclosure and is not necessarily prior art.

A door lock may be installed on a door and engaged to restrict entry into a building and/or into a room within a building during everyday use and/or during emergency situations, such as a school lockdown for example.

Many locks use the door frame as a support means for locking the door, but when a blunt force is applied to the door or to the lock (i.e., kicking the door or the lock, for example) the lock may fail. A need exists, therefore, for a more durable lock, a lock that may be easily installed, and lock that may be quickly and easily engaged.

SUMMARY

This section provides a general summary of the disclosure, and is not a comprehensive disclosure of its full scope or all of its features.

In one form, the present disclosure provides a device for restricting movement of a door including a first member, a second member, and a connecting member. The first member includes a first opening and the second member includes a second opening. The connecting member includes a first leg extending in a second direction and having a first mating feature removeably mounted within the first opening, and a second leg extending in a first direction that is angularly oriented with respect to the first direction and having a second mating feature removeably mounted within the second opening.

In some embodiments, the first mating feature defines a T-shape slidably engaging the first opening of the door member defining a T-slot.

In some embodiments, the first member includes a first edge and a second edge, the T-slot extending between the first edge and the second edge, the T-shape of the first mating feature slidably engaging the T-slot of the first opening from the first edge or from the second edge.

In some embodiments, the first mating feature defines a circular shape slidably engaging the first opening of the first member defining a circular-slot.

In some embodiments, the first member includes a first edge and a second edge, the circular-slot extending between the first edge and the second edge, the circular-shape of the first mating feature slidably engaging the circular-slot from the first edge or from the second edge.

In some embodiments, the second mating feature defines a rectangular shape received in the second opening of the second member defining a rectangular opening.

In some embodiments, a fastener received in a bore of the first member fixedly mounts the first member to the door.

In some embodiments, a fastener received in a bore of the floor member fixedly mounts the floor member to a floor.

In some embodiments, the second member includes a top face, the second member received in an opening of a floor surface such that the top face is flush with the floor surface.

In some embodiments, the second mating feature is received in a third opening in a floor surface located below the second opening.

In another form, the present disclosure provides an assembly for restricting movement of a moveably object comprising a first member and a connecting member. The first member includes a first opening defining a slot extending in a first direction, the first member being fixedly mounted to a moveable object. The connecting member includes a first leg and a second leg, the first leg extending in a second direction and having a first end slidably and removeably engaging the slot of the first member along the first direction. The second leg has a second end removeably engaging a fixed surface along the first direction simultaneously while the first end of the connecting member slidably and removeably engages the slot of the first member thereby restricting movement of the moveably object along a direction other than the first direction.

In some embodiments, the first end defines a T-shape slidably engaging the slot of the first member defining a T-slot.

In some embodiments, the first end defines a circular-shape slidably engaging the slot of the first member defining a circular-slot.

In some embodiments, the first member includes a first edge and a second edge, the slot extending from the first edge to the second edge.

In some embodiments, a fastener received in a bore of the first member fixedly mounts the first member to the moveable object, the moveable object defining a door.

In some embodiments, the assembly further comprises a second member having a second opening, the second member received in a bore of the fixed surface, the second end of the second leg of the connecting member removeably engaging the second opening of the second member.

In some embodiments, a perimeter of the first member includes chamfered edges, a perimeter of the second member includes chamfered edges, and a perimeter of the connecting member includes chamfered edges.

In yet another form, the present disclosure provides a device for restricting rotation of a door, comprising a door member and a connecting member. The door member includes a first opening having a first predetermined shape extending in a first direction and at least one bore extending in a second direction receiving a fastener therein to fixedly mount the door member to the door. The connecting member includes a first end removeably engaging the first opening along the first direction, the second leg extending in a third direction and having a second end removeably engaging a door frame thereby preventing rotation of the door.

In some embodiments, the first end defines a T-shape slidably engaging the first opening of the door member defining a T-slot.

In some embodiments, the second direction is perpendicular to the first direction and the third direction is perpendicular to the first direction and the second direction.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
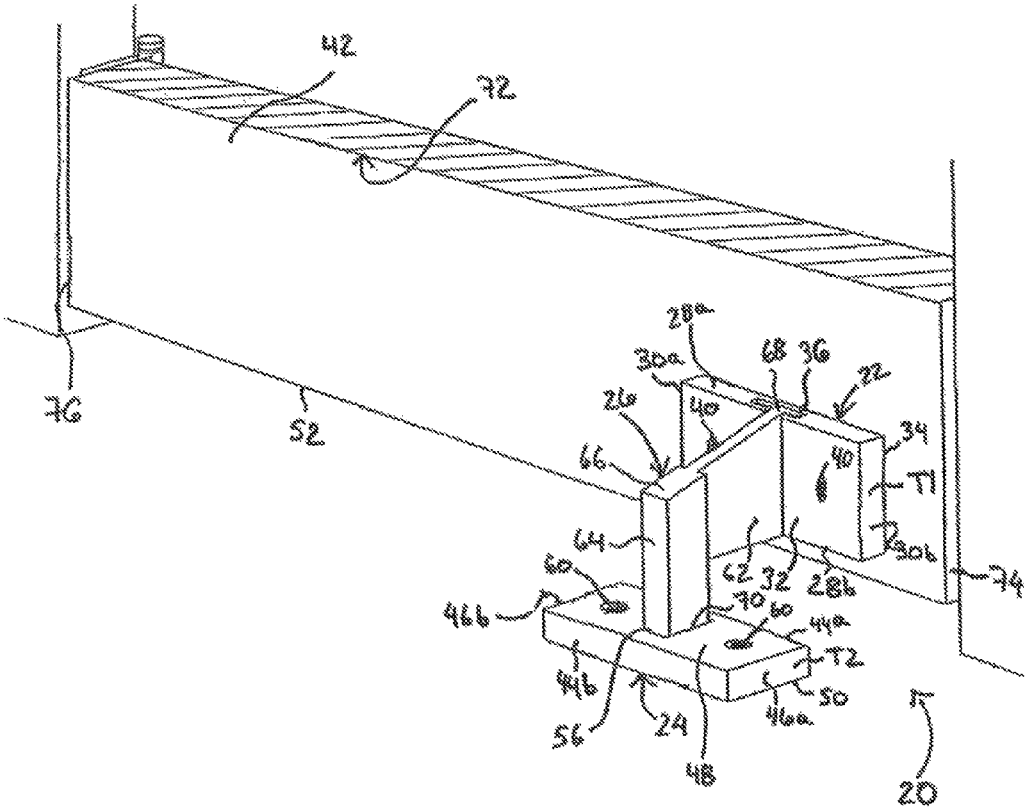
FIG. 1 is a perspective view of a door security device according to the principles of the present disclosure.
Figure 2:
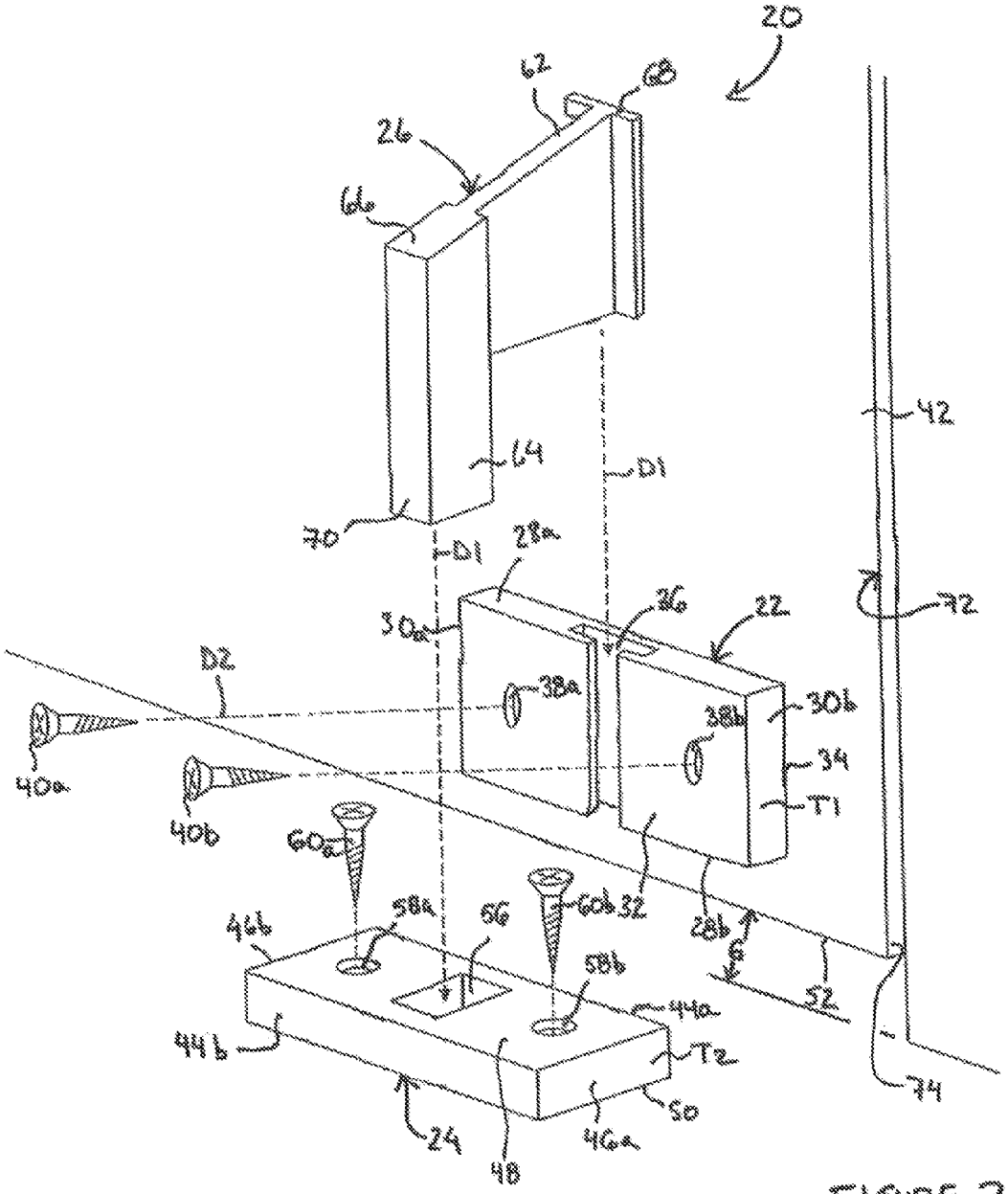
FIG. 2 is an exploded perspective view of the door security device of FIG. 1.
Figure 3:
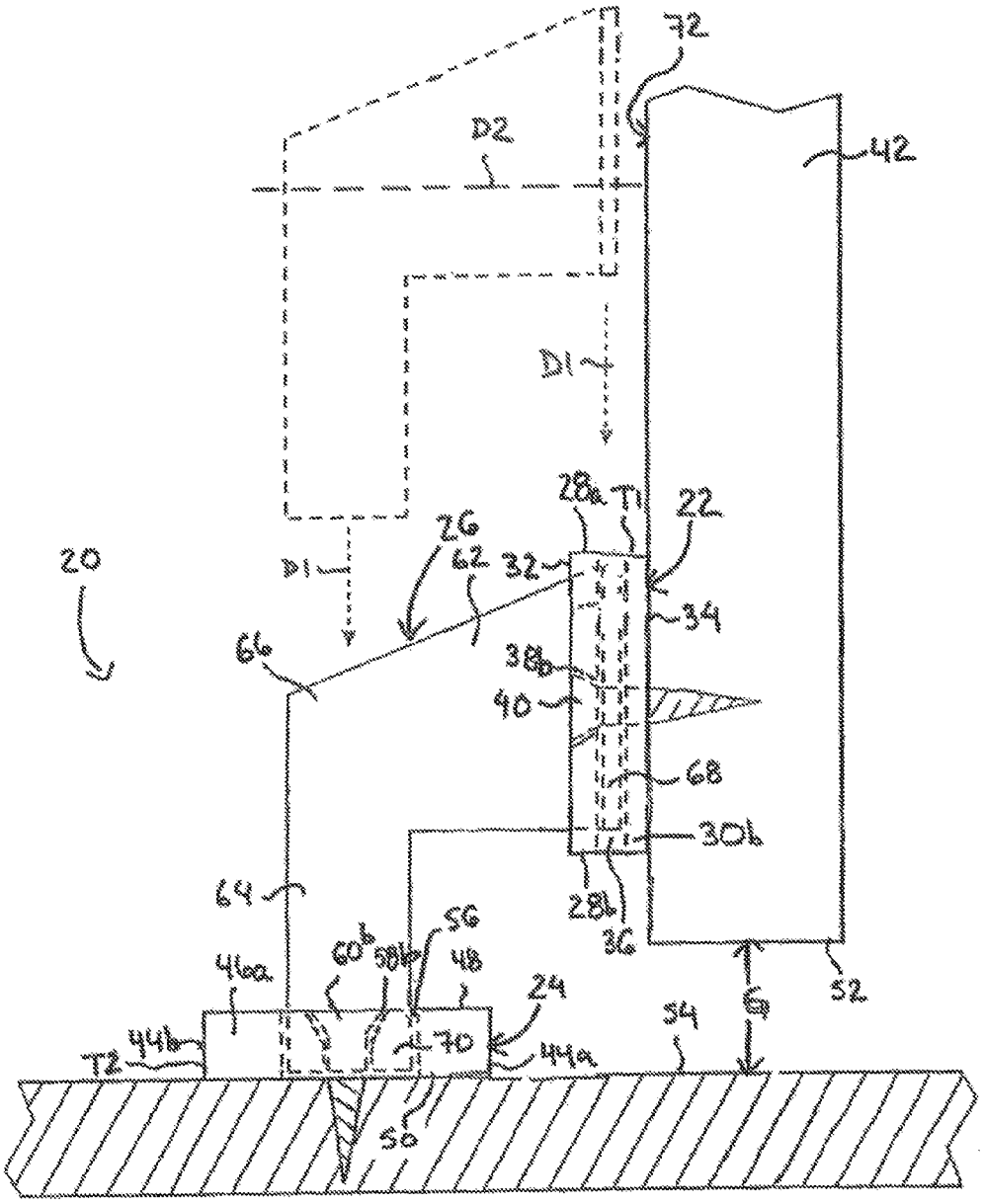
FIG. 3 is a partial cross section exploded view of the door security device of FIG. 1.
Figure 4:
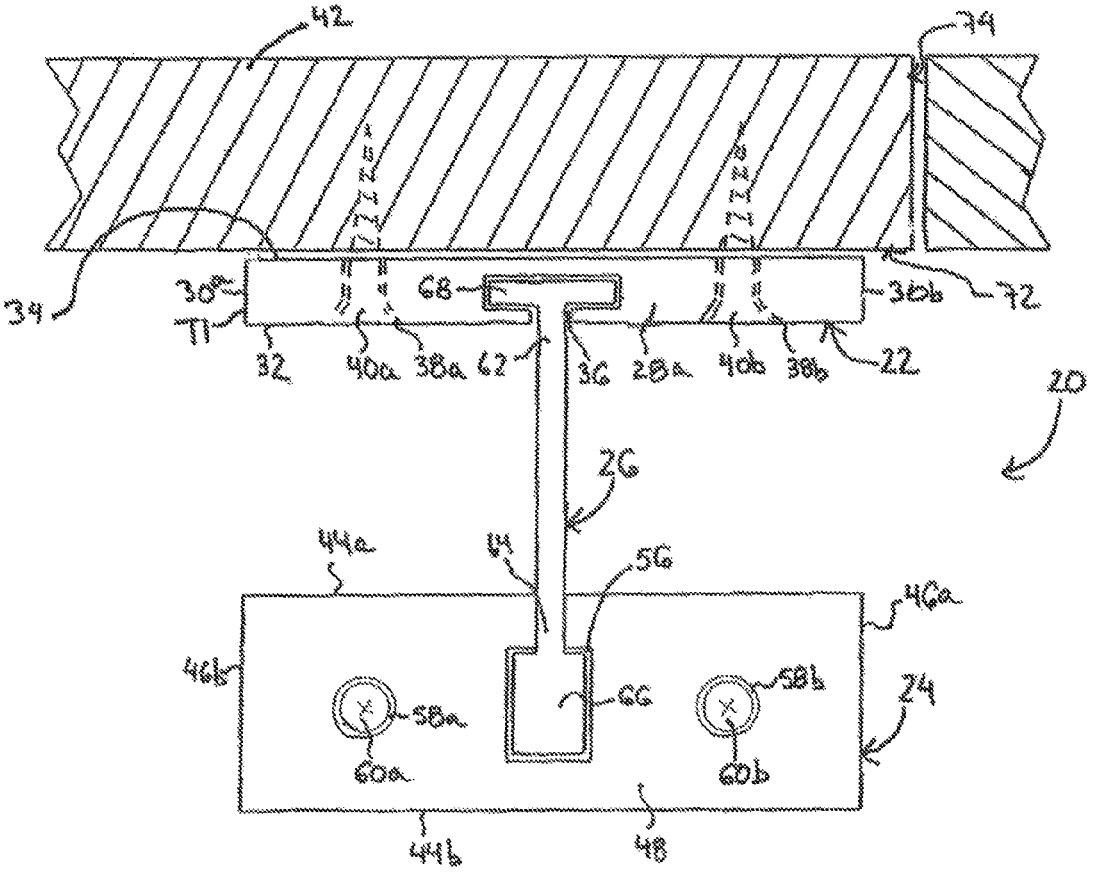
FIG. 4 is a partial cross section top plan view of the door security device of FIG. 1.
Figure 5:
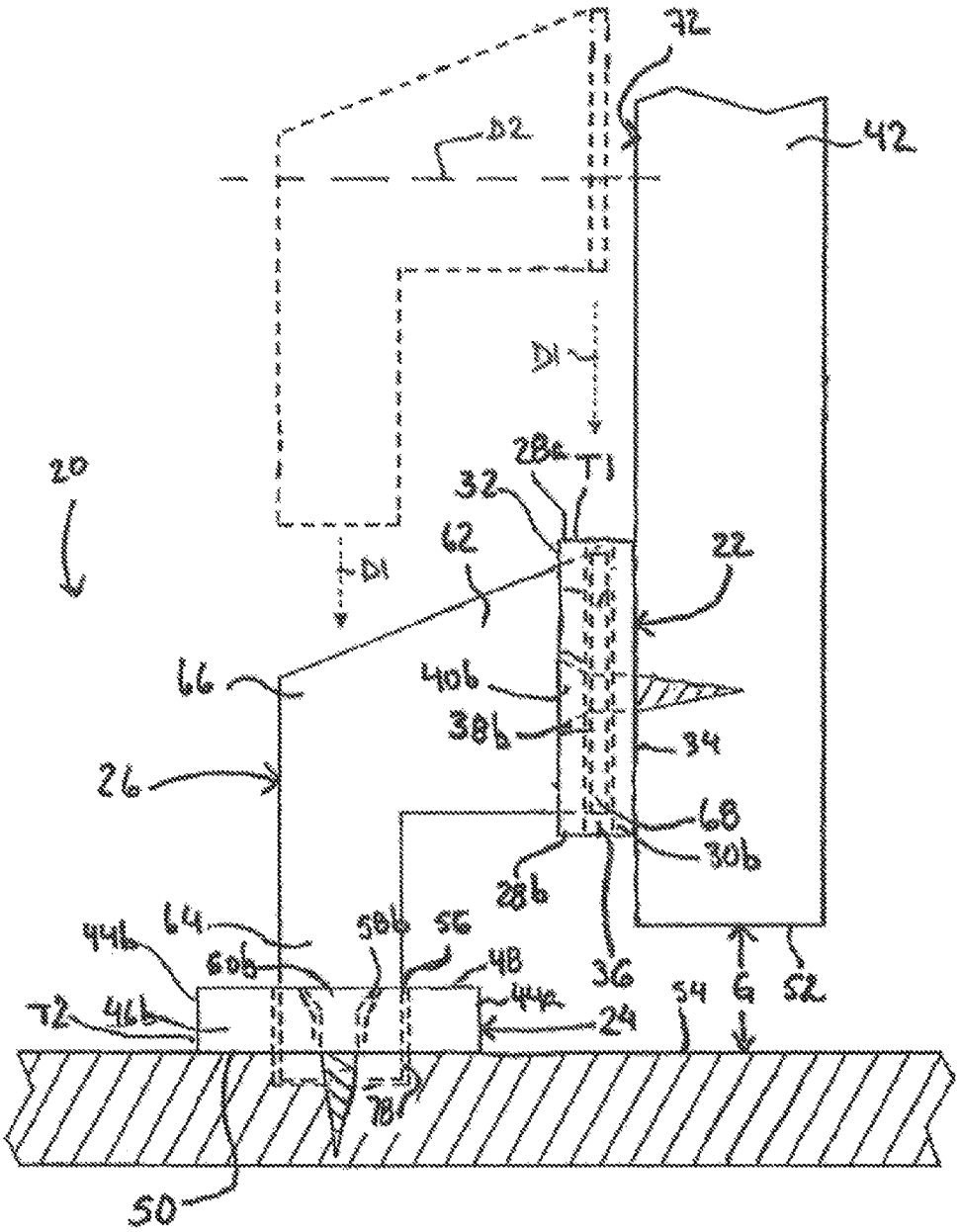
FIG. 5 is a partial cross section exploded view of the door security device of FIG. 1 showing another embodiment of the floor plate.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a door security device 20 is provided that includes a first member defining a door member or door plate 22, a second member defining a floor member or floor plate 24, and a third member defining a connecting member 26. The plates 22, 24 and the connecting member 26 are fabricated from a material having good strength properties, such as a metal or a polymeric composition for example.

The door plate 22 is an orthogonal member that includes a pair of opposing horizontal edges 28*a*, 28*b* and a pair of opposing vertical edges 30*a*, 30*b*. In an alternate embodiment, the door plate 22 may have a different geometry, such as a circular shape for example. The door plate 22 also includes a generally planar front face 32 and a generally planar back face 34 offset from the front face 32 by a thickness T1. The perimeter of the edges 28*a*, 28*b*, 30*a*, 30*b* and the faces 32, 34 may be chamfered and/or include fillets.

A slot 36 is located on the front face 32 of the door plate 22. The slot 36 may be a T-slot for example, extending along a first direction D1 for example between the two opposing horizontal edges 28*a*, 28*b* and at least partially into the thickness T1 of the door plate 22. In an alternate embodiment, the slot 36 may be a different type of slot, such as a circular slot for example. At least one bore 38*a*, 38*b* extends through the thickness T1 of the door plate 22 in a second direction D2, and each bore 38*a*, 38*b* receives a fastener 40*a*, 40*b* therein to fixedly mount the door plate 22 to a vertical face of a moveable object such as a door 42, as will be described further below. The door 42 may be a hinged, outwardly or inwardly swinging door or a sliding door for example. Although the present disclosure describes the door plate 22 and the various embodiments of the door plate 22 described below as being fixedly mounted to a door 42, it should be understood that the door plate 22 and its various embodiments may also be fixedly mounted to other moveable objects such as a hinged, outwardly or inwardly swinging window or sliding window.

The floor plate 24 is an orthogonal member that includes a pair of opposing longer edges 44*a*, 44*b* and a pair of opposing shorter edges 46*a*, 46*b*. In an alternate embodiment, the floor plate 24 may have a different geometry, such as a circular shape for example. The floor plate 24 includes a generally planar top face 48 and a generally planar bottom face 50 offset from the top face 48 by a thickness T2. It should be understood that the thickness T2 of the floor plate 24 should be less than a gap G located between a bottom edge 52 of the door 42 and a fixed, horizontal surface such as a floor 54 in order to allow the door 42 to open and freely move or swing inwardly and/or outwardly when the door security device 20 is fixedly mounted to a hinged door 42 and the door security device 20 in an unlocked position as will be described further below. The perimeter of the edges 44*a*, 44*b*, 46*a*, 46*b* and the faces 48, 50 may be chamfered and/or include fillets.

An opening 56 is located on the top face 48 of the floor plate 24. The opening 56 has a rectangular shape for example and extends at least partially into the thickness T2 of the floor plate 24. In an alternate embodiment, the opening 56 may extend through the entire thickness T2 of the floor plate 24. At least one bore 58*a*, 58*b* extends through the thickness T2 of the floor plate 24, and each bore 58*a*, 58*b* receives a fastener 60*a*, 60*b* therein to fixedly mount the floor plate 24 to the floor 54, as will be described further below.

The connecting member 26 is an L-shaped member that includes a first leg 62, a second leg 64, and a middle section 66. The first leg 62 has a rectangular cross-section extending in the second direction D2 (e.g. in a horizontal direction). It should be understood that the first leg 62 might be of any desired and predetermined length to bridge structural obstacles during use of the door security device 20. Such structural obstacles may include, for example, a door threshold, decorative trim, or a structural abnormality located on the floor 54. At a distal end, the first leg 62 includes a first mating feature 68. The first mating feature 68 has a T-shape for example, operable to slidably engage the T-slot 36 located in the door plate 22 along the first direction D1. As shown, the first leg 62 flares outwardly between a proximate end and the distal end; that is, the first leg 62 widens as it extends from the proximate end to the distal end. In an alternate embodiment, the first mating feature 68 may have a different shape, such as a circular shape for example, to slidably engage a matching circular slot in the door plate.

The second leg 64 of the connecting member 26 has a rectangular cross-section extending in the first direction D1 for example (e.g. in a vertical direction) that according to several aspects is perpendicular to the second direction D2, but can also be oriented at a non-perpendicular orientation. Like the first leg 62, it should be understood that the second leg 64 might also be of any desired and predetermined length to bridge structural obstacles during use of the door security device 20. At the distal end, the second leg 64 includes a second mating feature 70. The second mating feature 70 has a rectangular shape for example, operable to be removeably mounted into the opening 56 of the floor plate 24.

The middle section 66 of the connecting member 26 is located at the intersection of the proximate ends of the first and second legs 62, 64 and may be used for handling the connecting member 26, as will be described further below.

Installation and operation of the door security device 20 will now be described. A user may grip the middle section 66 of the connecting member 26 and position the first leg 62 of the connecting member 26 above one of the horizontal edges 28 of the door plate 22, such as horizontal edge 28*a*, such that the first mating feature 68 of the connecting member 26 engages the slot 36. The connecting member 26 is drawn downward along the first direction D1 towards the other horizontal edge 28*b* of the door plate 22 allowing the first mating feature 68 to slidably engage the slot 36. The back face 34 of the door plate 22 is placed against an inside wall 72 of the closed door 42. When possible, and preferably, the back face 34 should be placed against the inside wall 72 of the door 42 near an open edge 74 of the door 42, opposite a hinged edge 76 as shown in FIG. 1. The door plate 22 is oriented such that the horizontal edges 28*a*, 28*b* are positioned generally parallel to the floor 54 and the second mating feature 70 of the connecting member 26 rests on the floor 54. Fastener(s) 40*a*, 40*b* are inserted into the bore(s) 38*a*, 38*b* of the door plate 22 and subsequently driven into the inside wall 72 of the door 42 along the second direction D2 to fixedly mount the door plate 22 to the door 42. Anchor(s) (not shown) may also be installed in the door 42 for receiving the fastener(s) 40*a*, 40*b* therein and more securely mounting the door plate 22 to the door 42.

The bottom face 50 of the floor plate 24 is positioned against the floor 54 and aligned with the connecting member 26 such that the second mating feature 70 of the connecting member 26 engages the opening 56 in the floor plate 24 along the first direction D1 while the first mating feature 68 of the connecting member 26 maintains engagement with the slot 36 in the door plate 22. In an alternate embodiment shown in FIG. 5, a recess or opening 78 is made in the floor 54 below the opening 56 in the floor plate 24 to allow the second mating feature 70 of the connecting member to pass through the opening 56 in the floor plate 24 and also slidably engage the floor 54. Fastener(s) 60*a*, 60*b* are inserted into the bore(s) 58*a*, 58*b* of the floor plate 24 and subsequently driven into the floor 54 to fixedly mount the floor plate 24 to the floor 54. Anchor(s) may also be installed in the floor 54 for receiving the fastener(s) 60*a*, 60*b* therein and more securely mounting the floor plate 24 to the floor 54.

Once the door plate 22 and the floor plate 24 have been fixedly mounted to the door 42 and the floor 54, respectively, and the first and the second mating features 68, 70 of the connecting member 26 are engaged and retained within the slot 36 in the door plate 22 and the opening 56 in floor plate 24, respectively, the door security device 20 is in a locked position. In the locked position, the door 42 is restricted from moving. In other words, while the mating features 68, 70 of the connecting member 26 are engaged and retained within the door plate 22 and the floor plate 24, respectively, the door security device 20 opposes forces applied to the door 42 and restricts the door 42 from moving along a direction of the slot 36 and/or or swinging inwardly and/or outwardly.

To place the door security device 20 in an unlocked position, a user disengages and removes the first and the second mating features 68, 70 from within the slot 36 in the door plate 22 and the opening 56 in the floor plate 24, respectively, by gripping the middle section 66 of the connecting member 26 and drawing the connecting member 26 upwards and away from the floor 54 along the first direction D2. In the unlocked position, the door 42 is no longer restricted from moving along a direction of the slot 36 and/or or swinging inwardly and/or outwardly.

Figure 6:
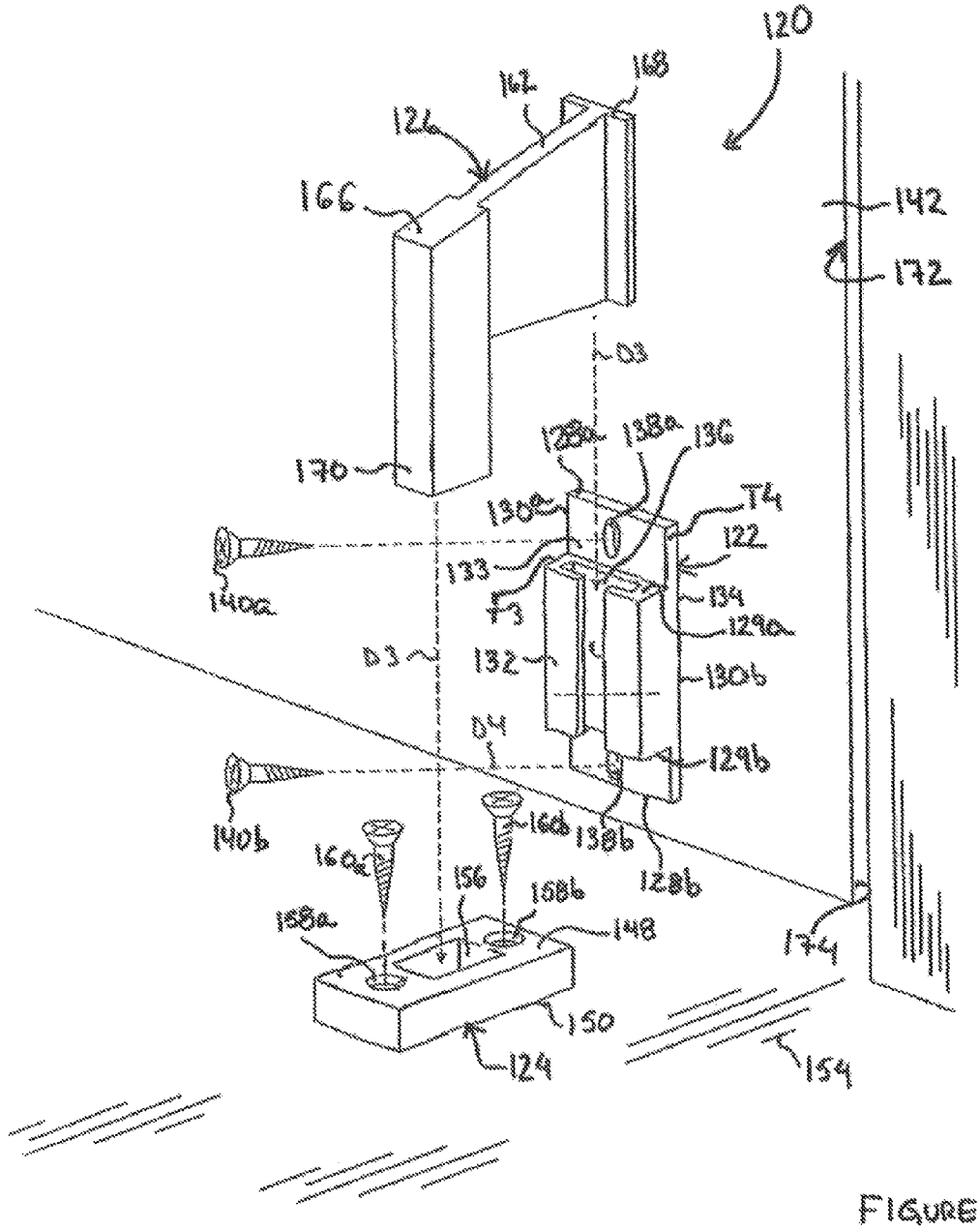
FIG. 6 is an exploded perspective view of another door security device according to the principles of the present disclosure.

With reference to FIG. 6, another door security device 120 is provided that includes a door plate 122, a floor plate 124, and a connecting member 126. The structures and/or functions of the floor plate 124 and the connecting member 126 are similar or identical to that of the floor plate 24 and the connecting member 26 described above, respectively, and therefore, will not be described again in detail herein.

The door plate 122 is an orthogonal member that includes a pair of first opposing horizontal edges 128*a*, 128*b*, a pair of second opposing horizontal edges 129*a*, 129*b*, and a pair of opposing vertical edges 130*a*, 130*b*. In an alternate embodiment, the door plate 122 may have a different geometry, such as a circular shape for example. The door plate 122 also includes a first generally planar front face 132, a second generally planar front face 133 offset from the first front face 132 by a thickness T3 and a generally planar back face 134 offset from the second front face 133 by a thickness T4. The perimeter of the edges 128*a*, 128*b*, 129*a*, 129*b*, 130*a*, 130*b* and the faces 132, 133, 134 may be chamfered and/or include fillets.

A slot 136 is located on the first front face 132 of the door plate 122. The slot 136 may be a T-slot for example, extending between the pair of second opposing horizontal edges 129*a*, 129*b* along a first direction D3 for example and at least partially into the thickness T3 of the door plate 122. In an alternate embodiment, the slot 136 may be a different type of slot, such as, for example, a circular slot. At least one bore 138*a*, 138*b* extends through the thickness T4 of the door plate 122 along a second direction D4 for example, and each bore 138*a*, 138*b* receives a fastener 140*a*, 140*b* therein to fixedly mount the door plate 122 to a door 142, as will be described further below.

Installation and operation of the door security device 120 will now be described. A user may grip a middle section 166 of the connecting member 126 and position a first leg 162 of the connecting member 126 above one of the two second opposing horizontal edges 129 of the door plate 122 such as horizontal edge 129*a* such that a first mating feature 168 of the connecting member engages the slot 136. The connecting member 126 is then drawn downward along the first direction D3 towards the opposite horizontal edge 129*b* of the door plate 122 allowing the first mating feature 168 to slidably engage the slot 136. The back face 134 of the door plate 122 is placed against an inside wall 172 of the closed door 142. Preferably, the door plate 122 should be placed against the inside wall 172 of the door 142 near an open edge 174 of the door 142. The door plate 122 is oriented such that the horizontal edges 128, 129 are arranged generally parallel to a floor 154 and a second mating feature 170 of the connecting member 126 rests on the floor 154. Fastener(s) 140*a*, 140*b* are inserted into the bore(s) 138*a*, 138*b* of the door plate 122 along the second direction D4 and subsequently driven into the inside wall 172 of the door 142 to fixedly mount the door plate 122 to the door 142. Anchor(s) (not shown) may also be installed in the door 142 for receiving the fastener(s) 140*a*, 140*b* therein and more securely mounting the door plate 122 to the door 142.

A bottom face 150 of the floor plate 124 is positioned against the floor 154 and aligned with the connecting member 126 such that the second mating feature 170 of the connecting member 126 engages an opening 156 in the floor plate 124 while the first mating feature 168 of the connecting member 126 maintains engagement with the slot 136 in the door plate 122. In another embodiment, a recess or opening may be made in the floor 154 below the opening 156 in the floor plate 124 to allow the second mating feature 170 of the connecting member to pass through the opening 156 in the floor plate 124 and slidably engage the floor 154. Fastener(s) 160*a*, 160*b* are inserted into bore(s) 158*a*, 158*b* of the floor plate 124 and subsequently driven into the floor 154 to mount the floor plate 124 to the floor 154. Anchor(s) (not shown) may also be installed in the floor 154 for receiving the fastener(s) 160*a*, 160*b* therein and more securely mounting the floor plate 124 to the floor 154.

Once the door plate 122 and the floor plate 124 have been fixedly mounted to the door 142 and the floor 154, respectively, and the first and the second mating features 168,170 of the connecting member 126 are engaged and retained within the slot 136 in the door plate 122 and the opening 156 in the floor plate 124, respectively, the door security device 120 is in a locked position. In the locked position, the door 142 is restricted from moving. In other words, while the mating features 168, 170 of the connecting member 126 are engaged and retained within the door plate 122 and the floor plate 124, respectively, the door security device 120 opposes forces applied to the door 142 and restricts the door 142 from moving along a direction of the slot 136 and/or or swinging inwardly and/or outwardly.

To place the door security device 120 in an unlocked position, a user disengages and removes the first and the second mating features 168, 170 from within the slot 136 in the door plate 122 and the opening 156 in the floor plate 124, respectively by gripping the middle section 166 of the connecting member 126 and drawing the connecting member 126 upwards along the first direction D1 and away from the top face 148 of the floor plate 124. In the unlocked position, the door 142 is no longer restricted from moving along a direction of the slot 136 and/or or swinging inwardly and/or outwardly.

Figure 7:
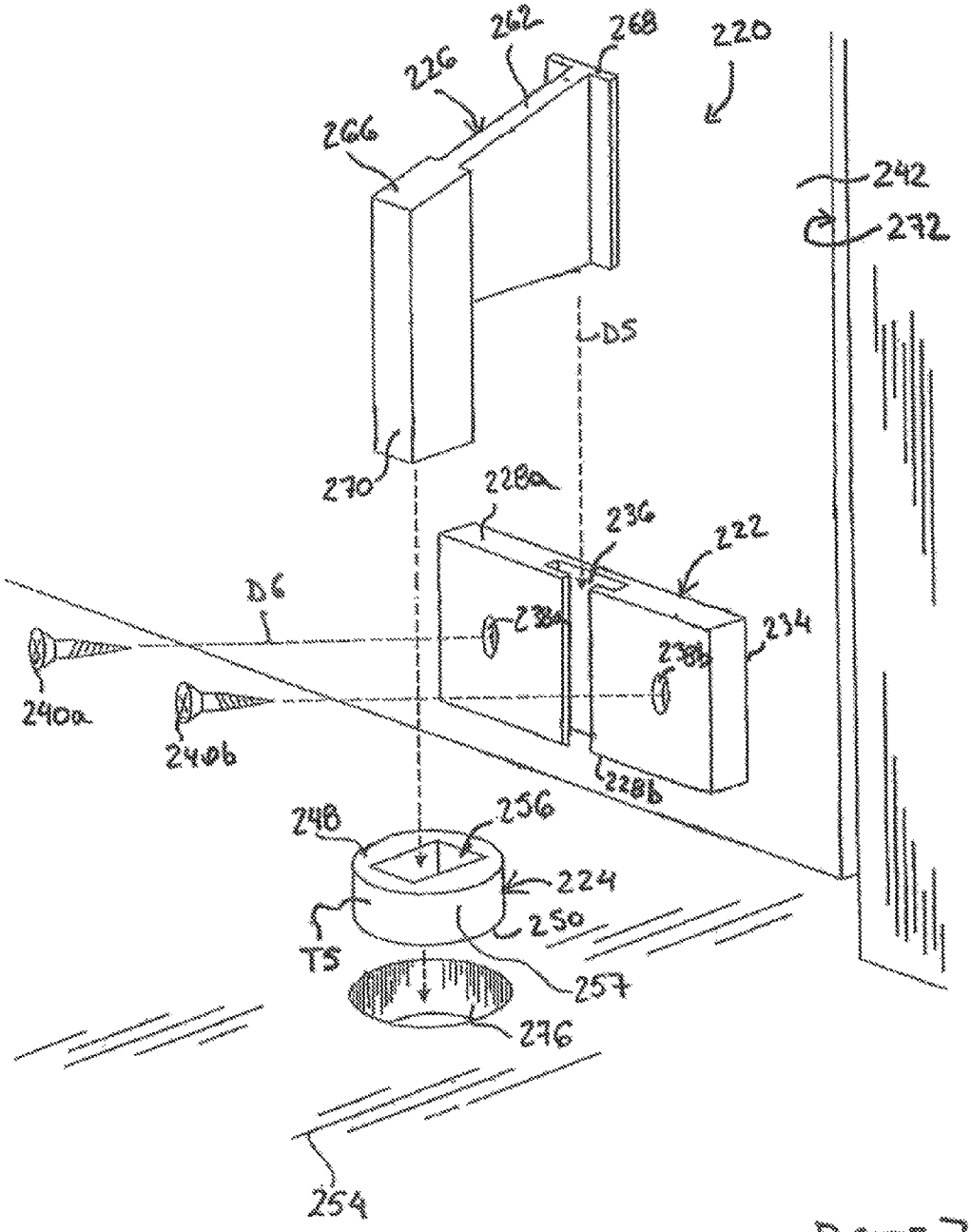
FIG. 7 is an exploded perspective view of another door security device according to the principles of the present disclosure.
Figure 8:
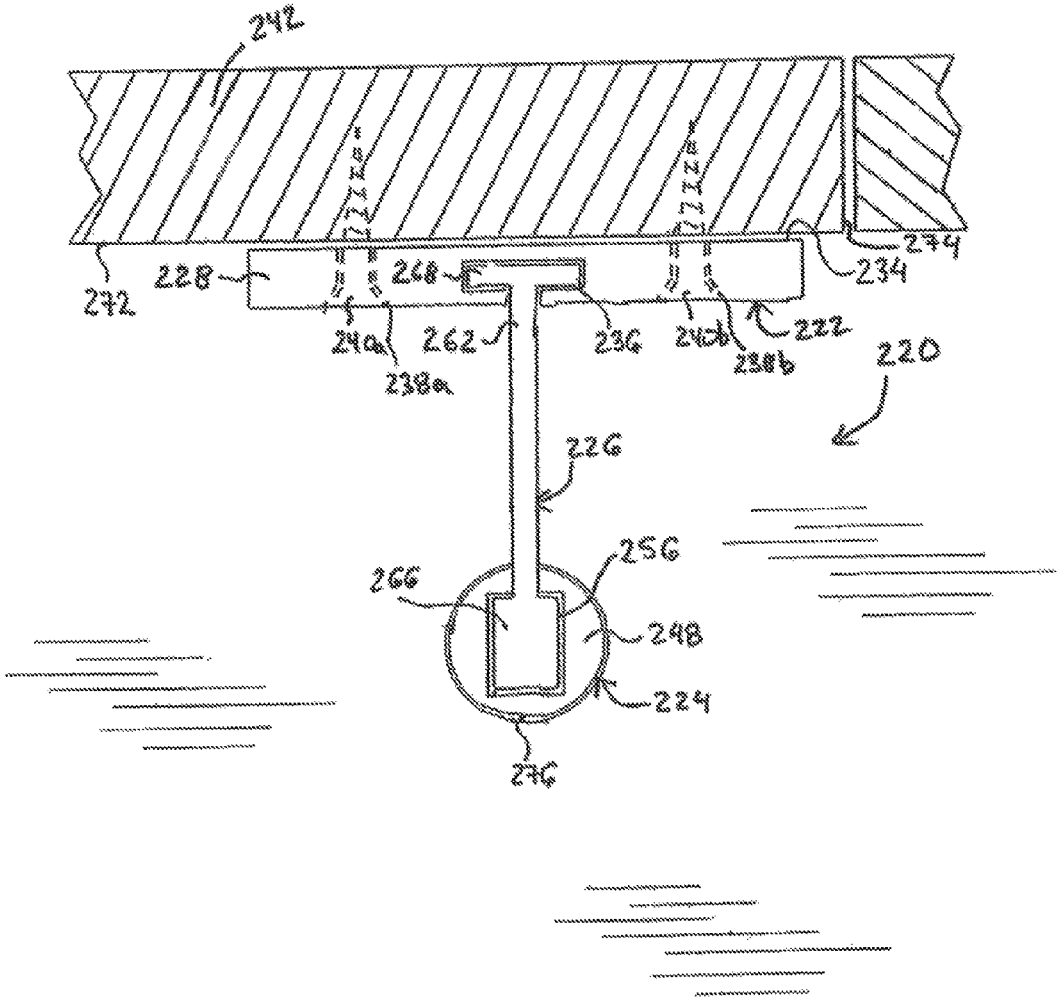
FIG. 8 is a partial cross section top plan view of the door security device of FIG. 7.

With reference to FIGS. 7 and 8, another door security device 220 is provided that includes a door plate 222, a floor plate 224, and a connecting member 226. The structures and/or functions of the door plate 222 and the connecting member 226 are similar or identical to that of the door plate 22 and the connecting member 26 described above, and therefore, will not be described again in detail herein.

The floor plate 224 is a circular member that includes a generally planar top face 248 and a generally planar bottom face 250 offset from the top face 248 by a thickness T5. In a further embodiment, the floor plate 224 may have a different geometry, such as a rectangular shape for example. The perimeter of the faces 248, 250 may be chamfered and/or include fillets.

An opening 256 is located on the top face 248 of the floor plate 224. The opening 256 has a rectangular shape for example, and may extend at least partially into the thickness T5 of the floor plate 224. In another embodiment, the opening 256 may extend through the entire thickness T5 of the floor plate 224. A bore may extend through the opening 256 and through the thickness T5 of the floor plate 224 and receives therein a fastener to fixedly mount the floor plate 224 to a floor 254, as will be described further below. Alternatively, an adhesive or cementing compound may be applied to an outer surface 257 of the floor plate 224 and/or to the bottom face 250 of the floor plate 224 to fixedly couple the floor plate 224 to the floor 254.

Installation and operation of the door security device 220 will now be described. A user may grip a middle section 266 of the connecting member 226 and position a first leg 262 of the connecting member 226 above a horizontal edge 228*a* of the door plate 222 such that a first mating feature 268 of the connecting member 226 engages a slot 236 located on the door plate 222. The connecting member 226 is then drawn downward along a first direction D5 for example towards the other horizontal edge 228*b* of the door plate 222 such that the first mating feature 268 slidably engages the slot 236. A back face 234 of the door plate 222 is placed against an inside wall 272 of a closed door 242. The door plate 222 is oriented such that the horizontal edges 228 are positioned generally parallel to the floor 254 and a second mating feature 270 of the connecting member 226 rests on the floor 254. Fastener(s) 240*a*, 240*b* are inserted into bores(s) 238*a*, 238*b* of the door plate 222 and driven into the inside wall 272 of the door 242 along a second direction D6 for example to fixedly mount the door plate 222 to the door 242. Anchor(s) (not shown) may also be installed in the door 242 for receiving the fastener(s) 240*a*, 240*b* therein and more securely mount the door plate 222 to the door 242.

An opening 276 is relieved in the floor 254 to receive the floor plate 224. Preferably, the floor plate 224 is received within the opening 276 such that the top face 248 of the floor plate 224 is made flush with, or is positioned slightly below the floor 254. The floor plate 224 is positioned and aligned with the connecting member 226 such that the second mating feature 270 of the connecting member 226 engages the opening 256 in the floor plate 224 while the first mating feature 268 of the connecting member 226 maintains engagement with the slot 236 in the door plate 222. An adhesive or cementing compound may be applied to the outer surface 257 of the floor plate 224 and/or to the bottom face 250 of the floor plate 224 to fixedly couple the floor plate 224 to the floor 254. In another embodiment, a second opening or recess is made in the floor 254 below the opening 256 in the floor plate 224 to allow the second mating feature 270 of the connecting member 226 to pass through the opening 276 in the floor plate 224 and also slidably engage the floor 254. A fastener is inserted into the bore of the floor plate 224 and subsequently driven into the floor 254 to securely mount the floor plate 224 to the floor 254. An anchor (not shown) may also be installed in the floor 254 for receiving the fastener and more securely mounting the floor plate 224 to the floor 24.

Once the door plate 222 and the floor plate 224 have been fixedly mounted to the door 242 and the floor 254, respectively, and the first and the second mating features 268, 270 of the connecting member 226 are engaged and retained within in the slot 236 of the door plate 222 and the opening 256 of the floor plate 224, respectively, the door security device 220 is in a locked position. In the locked position, the door 242 is restricted from moving. In other words, while the mating features 268, 270 of the connecting member 226 are engaged and retained within the door plate 222 and the floor plate 224, respectively, the door security device 220 opposes forces applied to the door 242 and restricts the door 242 from moving along a direction of the slot 236 and/or or swinging inwardly and/or outwardly.

To place the door security device 220 in an unlocked position, the user disengages and removes the first and the second mating features 268, 270 from within the slot 236 in the door plate 222 and the opening 256 in the floor plate 224, respectively, by gripping the middle section 266 of the connecting member 226 and drawing the connecting member 226 upwards and away from the top face 248 of the floor plate 224 along the first direction D5 for example. In the unlocked position, the door 242 is no longer restricted from moving along a direction of the slot 236 and/or or swinging inwardly and/or outwardly.

Figure 9:
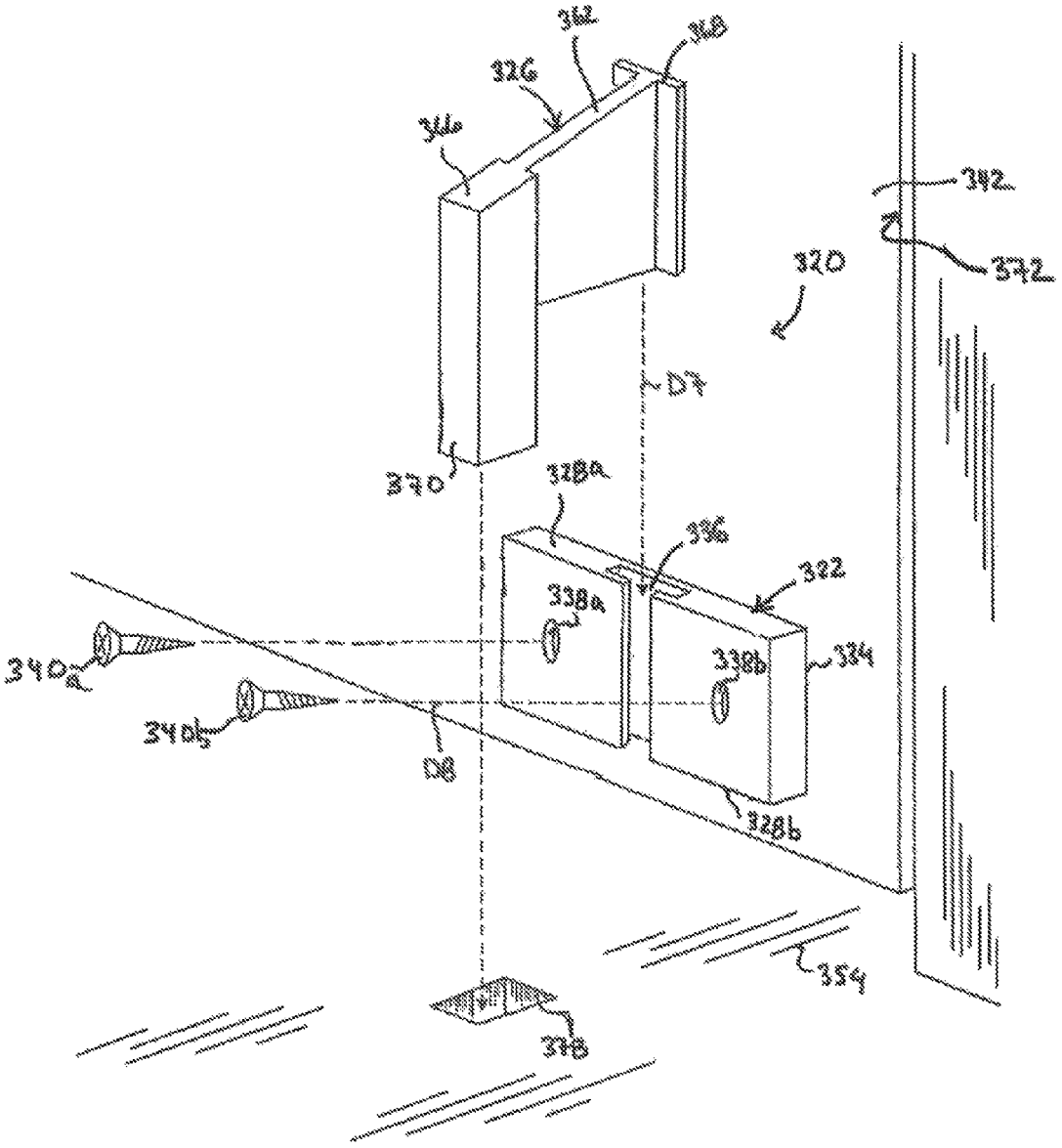
FIG. 9 is an exploded perspective view of another door security device according to the principles of the present disclosure.

With reference to FIG. 9, another door security device 320 is provided that includes a door plate 322 and a connecting member 326. The structures and/or functions of the door plate 322 and the connecting member 326 may be similar or identical to that of the door plate 22 and the connecting member 26 described above, and therefore, will not be described again in detail herein.

Installation and operation of the door security device 320 will now be described. A user may grip a middle section 366 of the connecting member 326 and position a first leg 362 of the connecting member 326 above a horizontal edge 328*a* of the door plate 322 such that a first mating feature 368 of the connecting member 326 engages a slot 336 located on the door plate 322. The connecting member 326 is drawn downward along a first direction D7 for example towards the other horizontal edge 328*b* of the door plate 322 such that the first mating feature 368 slidably engages the slot 336. A back face 334 of the door plate 322 is placed against an inside wall 372 of a closed door 342. The door plate 322 is oriented such that the horizontal edges 328 are positioned generally parallel to a floor 354 and a second mating feature 370 of the connecting member 326 rests on the floor 354. Fastener(s) 340*a*, 340*b* are inserted into bores(s) 338*a*, 338*b* of the door plate 322 along a second direction D8 for example and driven into the inside wall 372 of the door 342 to fixedly mount the door plate 322 to the door 342. Anchor(s) (not shown) may also be installed in the door 342 for receiving the fastener(s) 340*a*, 340*b* therein and more securely mount the door plate 322 to the door 342. An opening 378 is relieved in the floor 354 to slidably receive a portion of the second mating feature 370 of the connecting member 326.

Once the door plate 322 has been fixedly mounted to the door 342 and the first and the second mating features 368, 370 of the connecting member 326 are engaged and retained within the slot 336 of the door plate 322 and the opening 378 of the floor 354, respectively, the door security device 320 is in a locked position. In the locked position, the door 342 is restricted from moving. In other words, while the mating features 368, 370 of the connecting member 326 are engaged and retained within the door plate 322 and the floor plate 324, respectively, the door security device 320 opposes forces applied to the door 342 and restricts the door 342 from moving along a direction of the slot 336 and/or or swinging inwardly and/or outwardly.

To place the door security device 320 in an unlocked position, the user disengages and removes the first and the second mating features 368, 370 from within the slot 336 in the door plate 322 and the opening 378 in the floor 354, respectively, by gripping the middle section 366 of the connecting member 326 and drawing the connecting member 326 upwards along the first direction D7 and away from the floor 354. In the unlocked position, the door 342 is no longer restricted from moving along a direction of the slot 336 and/or or swinging inwardly and/or outwardly.

Figure 10:
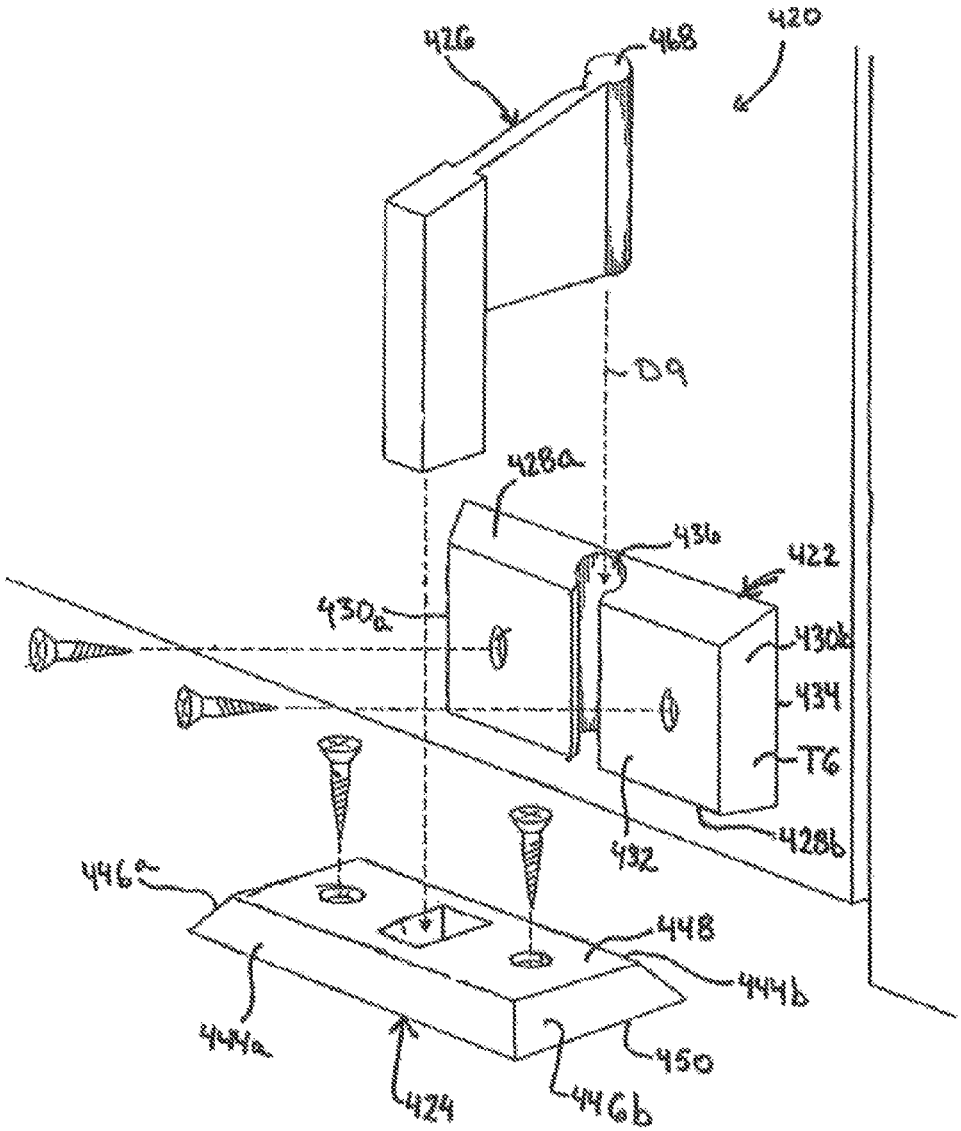
FIG. 10 is an exploded perspective view of yet another door security device according to the principles of the present disclosure.

With reference to FIG. 10, another door security device 420 is provided that includes a door plate 422, a floor plate 424, and a connecting member 426. The structures and/or functions of the floor plate 424 and the connecting member 426 are similar or identical to that of the floor plate 24 and the connecting member 26 described above, respectively, and therefore, will not be described again in detail herein.

The structures and/or functions of the door plate 422 are similar or identical to that of the door plate 22 described above, except a generally planar front face 432 is smaller than a generally planar back face 434 such that horizontal edges 428*a*, 428*b* and opposed vertical edges 430*a*, 430*b* are angled therebetween. The angled edges 428*a*, 428*b*, 430*a*, 430*b* provide a more sleek appearance and also enhance manufacturability and handling thereof. Moreover, a slot 436 extending between two opposing horizontal edges 428*a*, 428*b* along a first direction D9 for example and at least partially into a thickness T6 of the door plate 422 is shown as a circular slot.

The structures and/or functions of the floor plate 424 are similar or identical to that of the floor plate 24 described above, except a generally planar top face 448 is shown that is slightly smaller than a generally planar bottom face 450 such that longer edges 444*a*, 444*b* and a pair of opposing shorter edges 446*a*, 446*b* are angled therebetween. The angled edges 444*a*, 444*b*, 446*a*, 446*b* provide a more sleek appearance, enhance manufacturability and handling thereof, and mitigate against the floor plate 424 being as a trip hazard during use.

The structures and/or functions of the connecting member 426 are similar or identical to that of the connecting member 26 described above, except a first mating feature 468 is shown having a circular shape operable to slidably engage the circular-slot 436 located in the door plate 422. Installation and operation of the door security device 420 is similar or identical to that of the door security device 20 described above and, therefore, will not be described again in detail herein.

Figure 11:
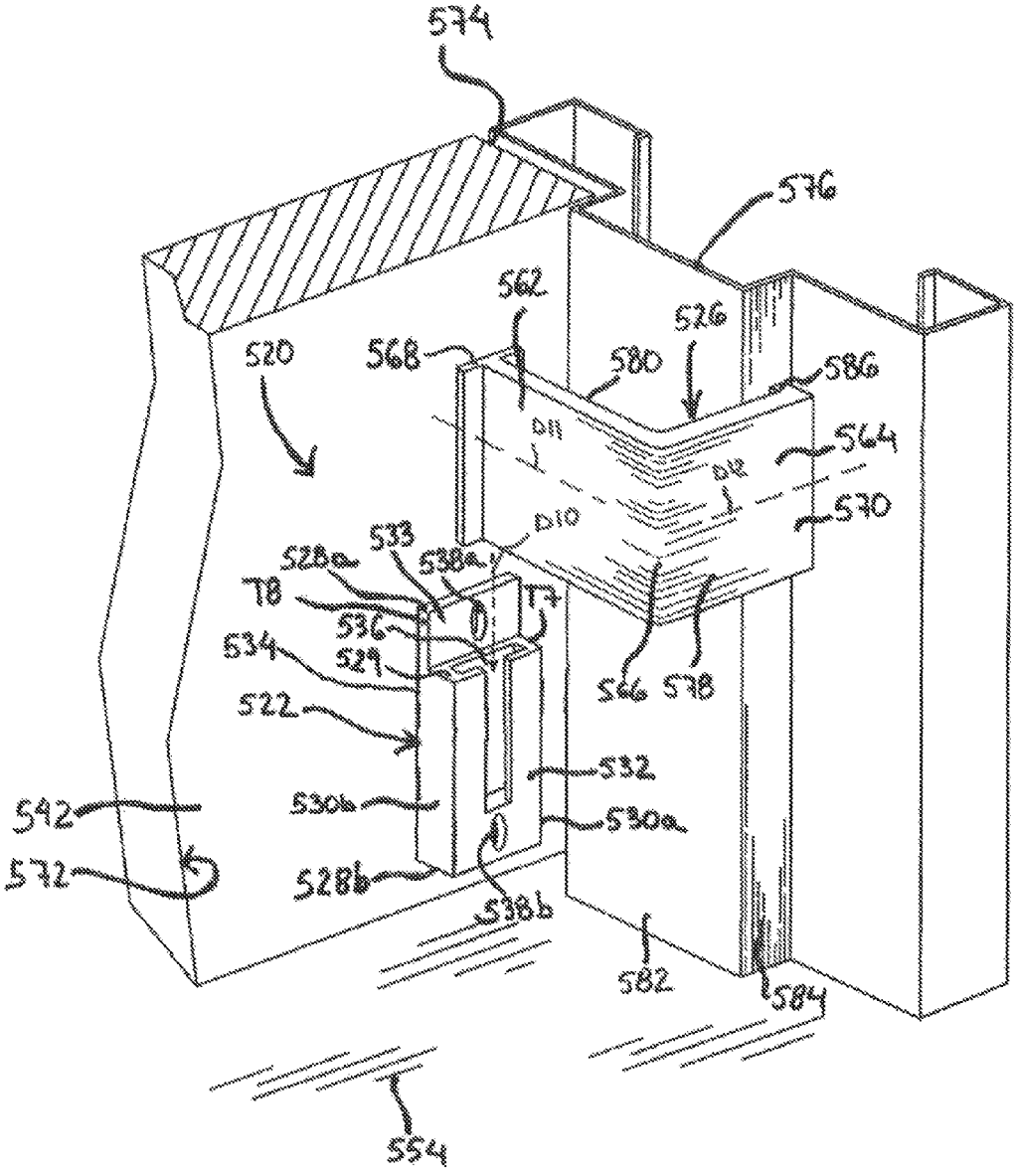
FIG. 11 is an exploded perspective view of yet another door security device according to the principles of the present disclosure.

With reference to FIG. 11, another door security device 520 is provided that includes a door plate 522 and a connecting member 526. The door security device 520 may be used with an outwardly swinging door 542 and double rabbet door frame 576 combination.

The door plate 522 is an orthogonal member that includes a pair of first opposing horizontal edges 528*a*, 528*b*, a second horizontal edge 529, and a pair of opposing vertical edges 530*a*, 530*b*. In an alternate embodiment, the door plate 522 may have a different geometry, such as a circular shape for example. The door plate 522 also includes a generally planar first front face 532, a generally planar second front face 533 offset from the first front face 532 by a thickness T7 and a generally planar back face 534 offset from the second front face 533 by a thickness T8. The perimeter of the edges 528*a*, 528*b*, 529, 530*a*, 530*b* and the faces 532, 533, 534 may be chamfered and/or include fillets.

A slot 536 is located on the first front face 532 of the door plate 522. The slot 536 may be a T-slot for example, extending from the second horizontal edge 529 along a first direction D10 for example towards the lower horizontal edge 528*b*. The slot 536 does not, however, extend all the way through the horizontal edge 528*b*. The slot 536 extends at least partially into the thickness T7 of the door plate 522. In an alternate embodiment, the slot 536 may be a different type of slot, such as, for example, a circular slot. A first bore 538*a* extends through the thickness T8 of the door plate 522 and a second bore 538*b* extends through the entire thickness T7+T8 of the door plate 522. Each bore 538*a*, 538*b* receives a fastener therein to fixedly mount the door plate 522 to the door 542, as will be described further below.

The connecting member 526 is an L-shaped member that includes a first leg 562, a second leg 564, and a middle section 566. Each of the legs 562, 564 and the middle section 566 includes a first face 578 and an opposite second face 580. The first leg 562 has a rectangular cross-section extending along a second direction D11 for example, and should be of a predetermined length to bridge structural obstacles during use of the door security device 520, such as, a soffit 582 of the double rabbet door frame 576. At a distal end, the first leg 562 includes a first mating feature 568. The first mating feature 568 has a T-shape for example, operable to slidably engage the T-slot 536 of the door plate 522. In an alternate embodiment, the first mating feature 568 may have a different shape, such as a circular shape for example, to slidably engage a matching circular slot in the door plate.

The second leg 564 of the connecting member 526 has a rectangular cross-section extending in a third direction D12 for example, that according to several aspects is perpendicular to the first direction D10 and the second direction D11, but can also be oriented at a non-perpendicular orientation. The second leg 564 should be of a predetermined length such that during use of the door security device 520 the second mating feature 570 can contact and engage a door stop 584 of the door frame 576. At the distal end, the second leg 564 includes a second mating feature 570 having a rectangular shape for example. In some embodiments, the second mating feature 570 may further include a protrusion 586 extending from the second face 580.

The middle section 566 of the connecting member 526 is located at the intersection of the proximate ends of the first and second legs 562, 564 and may be used for handling the connecting member 526.

Installation and operation of the door security device 520 will now be described. A user may grip the middle section 566 of the connecting member 526 and position the first leg 562 of the connecting member 526 above the second horizontal edge 529 of the door plate 522 such that a first mating feature 568 of the connecting member engages the slot 536. The connecting member 526 is then drawn in a downward direction along the first direction D10 towards the opposite horizontal edge 528*b* of the door plate 522 thereby allowing the first mating feature 568 to slidably engage the slot 536. The back face 534 of the door plate 522 is placed against an inside wall 572 of the door 542, near an open edge 574 of the door 542. The door plate 522 should be oriented such that the horizontal edges 528, 529 are arranged generally parallel to a floor 554 and the second mating feature 570 of the connecting member 526 makes contact with and engages a door stop 584 of the door frame 576. The door stop 584 may optionally include a protrusion (not shown) for the protrusion 586 of the second mating feature 570 to "hook onto" and engage the door stop 584. If the second leg 564 does not include the protrusion 586, the second face 580 of the second mating feature 570 makes contact with and engages the door stop 584. Shims or spacers may also be inserted between the back face 534 of the door plate 522 and the inside wall 572 of the door 542 if the second mating feature 570 is "short" and is not able to clear the soffit 582 and make contact with and engage the door stop 584. Fastener(s) (not shown) are inserted into the bore(s) 538*a*, 538*b* of the door plate 522 and subsequently driven into the inside wall 572 of the door 542 to fixedly mount the door plate 522 to the door 542. Anchor(s) (not shown) may also be installed in the door 542 for receiving the fastener(s) therein and more securely mounting the door plate 522 to the door 542.

Once the door plate 522 has been fixedly mounted to the door 542 and the first and the second mating features 568, 570 of the connecting member 526 are engaged and retained within the slot 536 in the door plate 522 and the door stop 584 of the door frame 576, respectively, the door security device 520 is in a locked position. In the locked position, the door 542 is restricted from moving.

To place the door security device 520 in an unlocked position, a user disengages and removes the first mating feature 568 of the connecting member 526 from within the slot 536 in the door plate 522 by gripping the middle section 566 of the connecting member 526 and drawing the connecting member 526 upwards along the first direction D10 and away from the floor 554 and disengaging the second mating feature 570 from the door stop 584. In the unlocked position, the door 542 is no longer restricted from opening.

Figure 12:
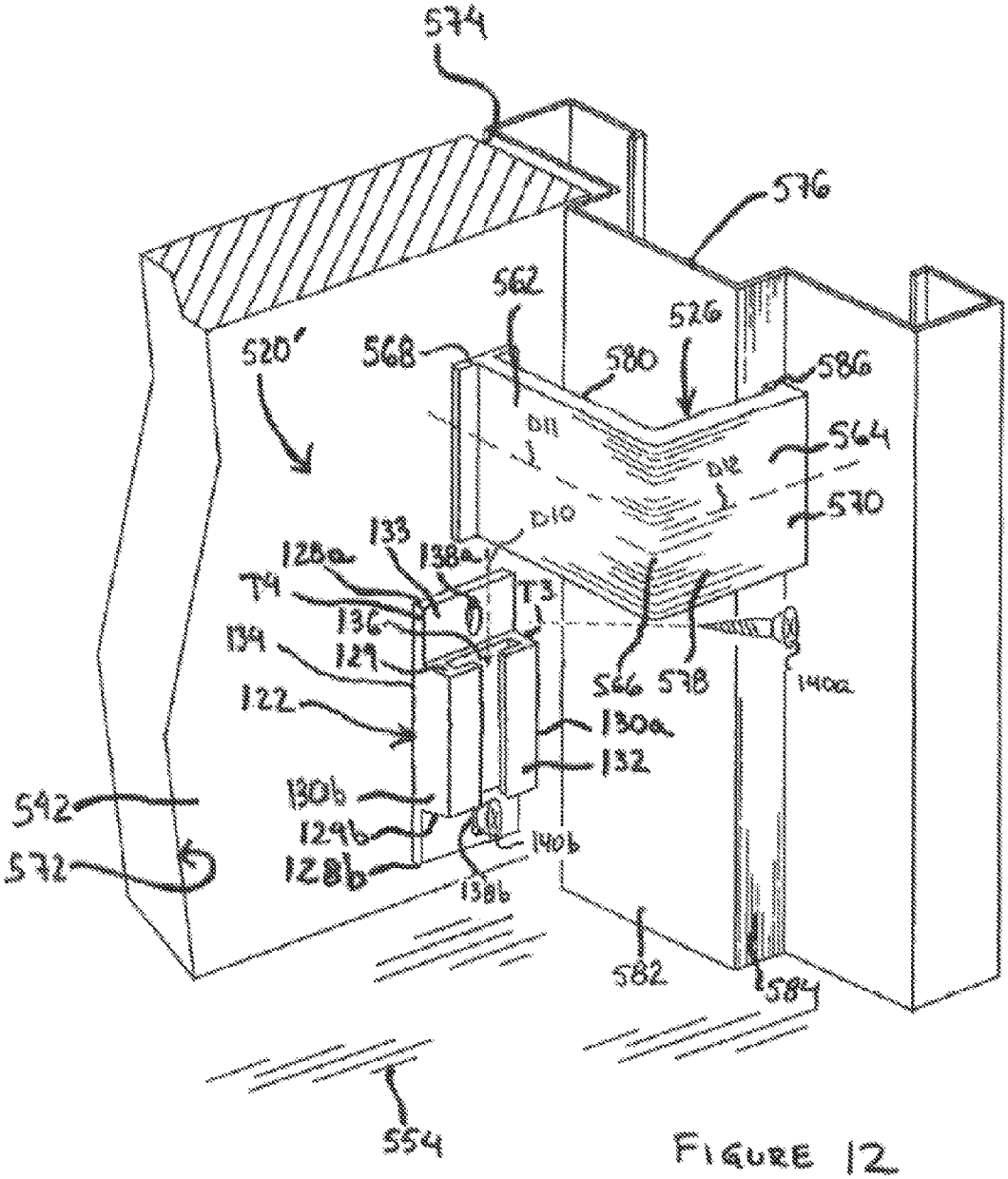
FIG. 12 is an exploded perspective view of yet another door security device according to the principles of the present disclosure.

With reference to FIG. 12, another door security device 520' is provided. The door security device 520' is similar to the door security device 520 (FIG. 11), except that the door security device 520' includes the door plate 122 (previously illustrated in FIG. 6 and described above with reference to FIG. 6) instead of the door plate 522 (FIG. 11). Since the door plate 122 is already described in detail above with reference to FIG. 6, its description is not repeated here in detail. The person of skill in the art will appreciate that the door plate 122 is generally similar to the door plate 522, except that the slot 136 is open at the bottom (i.e., at the second horizontal edge 129*b*).

The door security device 520' can generally operate similar to the door security device 520, described above with reference to FIG. 11 to prevent the door 542 from opening. In one example, the door plate 522 can be positioned close enough to the floor 554 such that a portion of the first mating feature 568 can fall through the open bottom of the slot 136 until the bottom of the connecting member 526 rests on the floor 554. With the bottom of the connecting member 526 resting on the floor 554, a portion of the first mating feature 568 can still be disposed within the slot 136 to secure the connecting member 526 to the door 542. As described above, the connecting member 526 can engage the door stop 584 to lock the door relative to the door frame 576.

In an alternative example, the door plate 522 can be positioned at any height on the door 542 and the connecting member 526 can be prevented from falling out of the bottom of the slot 136 by the fastener 140*b* that is received in the bore 138*b*. In other words, the bore 138*b* can be aligned with the slot 136, such that the fastener 140*b* can be screwed into the door 542 while a portion of the fastener 140*b* (e.g., the head of the fastener) can still block the connecting member 526 from falling out of the bottom of the slot 136. When this configuration is used with the door plate 522 higher than the distance between the bottom and top of the connecting member 526, this configuration has the added benefit of being able to unlock the door 542 by simply removing the lower fastener 140*b*. In other words, removing the lower fastener 140*b* can cause the connecting member to fall out of the door plate 522 and release the door 542.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A device for restricting movement of a swinging door in a door frame, the door frame having a door soffit extending longitudinally in a first direction from a first longitudinal end of the door soffit to a second longitudinal end of the door soffit, the device comprising:

a door member configured to be fixedly coupled to the swinging door such that the door member has a first side facing in the first direction, a second side that is opposite the first side, and an outer side facing away from the door, the door member including a slot that is open at the first and outer sides of the door member, the slot having a first predetermined shape extending parallel to the door soffit from the first side, the slot extending along an axis from the first side to the second side and being open at the second side; and a connecting member including a first leg and a second leg, the first leg extending in a second direction that is transverse to the first direction, the first leg having a first end and a second end, the first end having a second predetermined shape configured to mate with the first predetermined shape, the second leg extending in a third direction that is transverse to the second direction, the second leg having a third end and a fourth end, the fourth end being rigidly coupled to the second end;

wherein when the connecting member is in a first position relative to the door member: the first end is disposed within the slot, the first leg extends through the outer side of the door member, and the third end overlaps with the door soffit thereby preventing rotation of the swinging door;

wherein when the connecting member is in the first position, the connecting member is translatable in the first direction to a second position wherein the connecting member is disengaged from the door member.

2. The device of claim 1, wherein the first predetermined shape is a T-shape and the second predetermined shape is a mating T-shape slidably received within the T-shape of the first predetermined shape to engage the slot.

3. The device of claim 1, wherein the second direction is perpendicular to the first direction and the third direction is perpendicular to the first direction and the second direction.

4. The device of claim 1, wherein the door member includes an inner side that faces toward the door and the door member defines a first bore that extends through the outer and inner sides of the door member, wherein the first bore is aligned with the axis.

5. The device of claim 4, wherein the first bore is directly below the slot.

6. The device of claim 4, further comprising a first fastener, wherein a portion of the first fastener extends through the first bore to fixedly mount the door member to the door.

7. The device of claim 1, wherein when the connecting member is in the first position, the third end overlaps with and engages a door stop of the door soffit to thereby prevent rotation of the swinging door.

8. The device of claim 1, wherein the third end includes a protrusion configured to engage a protrusion of the soffit when the connecting member is in the first position.

9. The device of claim 1, wherein the first longitudinal end of the door soffit is proximal to a floor and the second longitudinal end is distal to the floor.

10. A device for restricting movement of a swinging door in a door frame, the door frame having a door soffit extending longitudinally from a first longitudinal end of the door soffit to a second longitudinal end of the door soffit, the device comprising:

a door member configured to be fixedly coupled to the swinging door such that the door member has an outer side facing away from the door, a first side that is transverse to the outer side and faces in a first direction, and a second side that is opposite the first side, the door member including a slot that is open at the first side of the door member and the outer side of the door member, the slot extending longitudinally along an axis from the first side toward the second side of the door member and being open at the second side, the slot having a first predetermined shape; and a connecting member including a first leg and a second leg, the first leg extending in a second direction that is transverse to the first direction, the first leg having a first end and a second end, the first end having a second predetermined shape configured to mate with the first predetermined shape, the second leg extending in a third direction that is transverse to the second direction, the second leg having a third end and a fourth end, the fourth end being rigidly coupled to the second end;

wherein when the connecting member is in a first position relative to the door member: the second predetermined shape is disposed within the slot thereby preventing movement of the connecting member in the second direction, and the third end overlaps with the door soffit thereby preventing rotation of the swinging door;

wherein when the connecting member is in the first position, the connecting member is translatable in the first direction to a second position wherein the connecting member is disengaged from the door member.

11. The device of claim 10, wherein when the connecting member is in the first position relative to the door member, the first leg extends through the outer side of the door member.

12. The device of claim 10, wherein the first predetermined shape is a T-shape and the second predetermined shape is a mating T-shape slidably received within the T-shape of the first predetermined shape to engage the slot.

13. The device of claim 10, wherein the second direction is perpendicular to the first direction and the third direction is perpendicular to the first direction and the second direction.

14. The device of claim 10, wherein the door member includes an inner side that faces toward the door and the door member defines a first bore that extends through the outer and inner sides of the door member, wherein the first bore is aligned with the axis proximal to the second side.

15. The device of claim 14, further comprising a first fastener, wherein a portion of the first fastener extends through the first bore to fixedly mount the door member to the door.

16. The device of claim 10, wherein when the connecting member is in the first position, the third end overlaps with and engages a door stop of the door soffit to thereby prevent rotation of the swinging door.

17. The device of claim 10, wherein the third end includes a protrusion configured to engage a protrusion of the soffit when the connecting member is in the first position.

18. The device of claim 10, wherein the first longitudinal end of the door soffit is proximal to a floor and the second longitudinal end is distal to the floor.

* * * * *